US005223664A

United States Patent [19]

Rogers

[11] Patent Number: 5,223,664

[45] Date of Patent: Jun. 29, 1993

[54] FLEXIBLE DETONATING CORD

[75] Inventor: Trevor E. Rogers, Orpington, England

[73] Assignee: The Secretary of State for Defence in Her Britannic Majesty's Government of the United Kingdom of Great Britain and Northern Ireland, London, England

[21] Appl. No.: 828,817

[22] PCT Filed: Sep. 11, 1990

[86] PCT No.: PCT/GB90/01400

§ 371 Date: Jan. 29, 1992

§ 102(e) Date: Jan. 29, 1992

[87] PCT Pub. No.: WO91/04235

PCT Pub. Date: Apr. 4, 1991

[30] Foreign Application Priority Data

Sep. 15, 1989 [GB] United Kingdom ..... 8920954

[51] Int. Cl.[5] ..... C06C 5/04

[52] U.S. Cl. ..... 102/275.1; 102/275.8

[58] Field of Search ..... 102/275.1, 275.5, 275.8, 102/275.6

[56] References Cited

U.S. PATENT DOCUMENTS

| | | | |
|---|---|---|---|
| 2,982,210 | 5/1961 | Andrew et al. | 102/275.8 |
| 3,903,800 | 9/1975 | Kilmer | 102/275.8 |
| 4,178,853 | 12/1979 | Garrison et al. | 102/275.8 |
| 4,607,573 | 8/1986 | Thoreson et al. | 102/275.5 |
| 4,991,511 | 2/1991 | Simpson | 102/275.1 |

FOREIGN PATENT DOCUMENTS

| | | |
|---|---|---|
| 2166732 | 8/1973 | France . |
| 2638738 | 5/1990 | France . |
| 150678 | 3/1921 | United Kingdom . |
| 815532 | 6/1959 | United Kingdom . |

OTHER PUBLICATIONS

Chemical Abstracts, vol. 98, No. 2, Jan. 1983, Columbus, Oh., p. 84; Nissan Motor Co.

*Primary Examiner*—David H. Brown
*Attorney, Agent, or Firm*—Nixon & Vanderhye

[57] ABSTRACT

A flexible non destructing detonating cord including an inner sheath (2) of 99.5% pure aluminium or silver which is drawn down to an outer diameter of 0.85 mm so as to compress an NHS explosive core (1) to a density of between 1.2 and 1.6 g/cc. The cord also includes an outer sheath (3) of stainless steel which is drawn down to an outer diameter of 2.00 mm into gripping contact with the inner sheath and acts to prevent swelling of the cord when the explosive in the cord is detonated. The invention also provides a method of manufacturing the detonating cord.

19 Claims, 1 Drawing Sheet

FLEXIBLE DETONATING CORD

BACKGROUND OF THE INVENTION

1. Field of the Invention

The present invention relates to flexible detonating cord containing high explosive useful for linking explosive events when a specific short delay is required between the events.

2. Description of the Prior Art

When detonating cord is to be used in close proximity to a charge of explosive or sensitive material it is important that the cord's detonation energy is contained. In order to overcome this containment problem a detonating delay cord has been proposed in the past which consists of an inner flexible sheath of a ductile metal such as silver which contains a core of high explosive, surrounded by a high strength outer sheath of stainless steel which acts to contain the products of core detonation. In order to allow the shock wave produced by the core detonation to be attenuated sufficiently that the outer sheath can contain the detonation products completely without undergoing any plastic deformation, the sheaths are separated by an annular air gap. The resulting cord has an overall outside diameter in the order of 5 mm and is consequently inflexible and relatively heavy. A support structure is also required in order to support the inner sheath centrally within the outer sheath.

In a weapon system in which a small time delay is required (in the order of 100–500 μs) between detonation events the inflexibility and size of the detonating cord described above is a distinct disadvantage as the delay cannot be achieved by coiling an appropriate length of cord into a confined space. One solution to this problem is to incorporate a short relatively slow burning section of pyrotechnic delay cord into the detonating cord with a sensitive primary initiating composition introduced where the pyrotechnic reaction is to be converted into a detonating regime. Safety considerations however dictate that such conversion systems have to be protected by a relatively bulky and complicated physical shuttering device in order to prevent accidental detonation taking place.

A detonating cord with limited flexibility is disclosed in the U.S. Pat. No. 4,178,853 which comprises an explosive core surrounded by a plurality of braided plastic fibre coverings and an outer braided steel fibre covering. In order to merely prevent rupture of the cord upon detonation between 6 and 12 layers of fibre coverings are required depending on the fibre employed, resulting in the cord having a pre-fired diameter of between 6 mm and 12 mm. The reference to the pre-fired diameter clearly indicates that the cord swells on detonation. Apart from its bulk this cord will presumably be expensive to produce and relatively inflexible due to its multi-braided construction.

A further detonating cord is described in French patent 2166732 which has an inner lead sheath and an outer steel sheath having outer diameters of 3.8 mm and 5.0 mm respectively. The object of the invention is to reduce the scatter of detonation speed of the cord by avoiding complete disintegration of the cord upon detonation. However no claim is made that plastic deformation of the cord will be prevented. The high ductility of lead used for the inner sheath limits the extent to which the explosive is compressed as the sheath is drawn down to a small diameter. This results in a larger core than is desirable being used in the final cord which makes containment of the detonation more difficult and will reduce the flexibility of the cord indeed the specification makes no reference to the cord being easily curvable.

SUMMARY OF THE INVENTION

It is the object of the invention to provide a detonating cord which (a) is sufficiently flexible and narrow to allow it to be coiled in a confined space, (b) confines the products resulting from detonation of the cord, and (c) does not expand when detonated. A combination of these features would enable the cord to be compactly overwound with successive coils tightly wound on top of one another, enabling a long cord with a significant time delay to be coiled into a confined space.

Thus according to a first aspect of the invention there is provided a flexible detonating cord comprising a core of radially compacted high explosive contained within an inner sheath and an outer sheath which outer sheath coaxially grippingly engages the inner sheath the hoop strength of the outer sheath being greater than that of the inner sheath characterised in that the outer sheath has an outer diameter of less than 2.50 mm and has a hoop strength which is sufficient to prevent plastic deformation of the outer sheath when the cord is detonated.

By providing an outer containment sheath which is both reduced in diameter to below 2.50 mm and in gripping engagement with the inner sheath the flexibility of the cord as a whole is significantly increased thus facilitating coiling and obviating the need to provide separate supports for the inner sheath. Furthermore radial compaction of the core enables a smaller diameter detonation sustaining core to be employed. This in turn reduces the thickness and diameter of the outer sheath required to contain the products of core detonation, so further improving the flexibility of the cord.

The material of the inner sheath is preferably more ductile than the material of the outer sheath. A relatively ductile inner sheath is preferred so that the method of drawing down the inner sheath to radially compact the core will not cause over compaction of the explosive. The inner and outer sheaths are preferably made of different metals.

A core of any explosive material will have a critical diameter below which propagation of a detonation wavefront along the core will not occur, and this critical diameter is known to decrease as the density of the explosive increases. Since a small diameter cord is desirable to provide it with a reasonable degree of flexibility, the explosive material in the core is preferably sufficiently compacted so that it has a density of between 1.2 and 1.6 g/cm$^3$. Such a core density allows the core to have a small diameter of typically between 0.5 mm and 0.8 mm and consequently means that the energy produced by detonation of the cord will be correspondingly low and for this reason a thinner walled outer sheath may be used which in turn adds to the cord's light weight and flexibility.

Suitable materials for the inner sheath are aluminium and silver. If the inner sheath is too ductile drawing it down to reduce its diameter will not result in sufficient compaction of the explosive. Conversely if the ductility is too low the drawing process will over-compress the explosive so reducing reliability of detonation.

In order to completely constrain the inner sheath against radial expansion without requiring unduly thick walls (i.e. maintain flexibility and small size) the material of outer sheath preferably has an ultimate tensile strength above 500 MPa after it has been drawn down onto the inner sheath. The hoop strength of the outer sheath is preferably over 15 times greater than the hoop strength of the inner sheath.

Preferably the outer sheath is made from a metal which significantly work hardens such as steel. The use of such a metal for the outer sheath has the advantage that in drawing the sheath down its strength is considerably increased and at the same time its flexibility is also increased by virtue of wall thinning and diameter reduction.

A suitable explosive for use in the detonating cord is HNS (hexanitrostilbene) which occurs in crystalline form and which thus facilitates the initial filling of the inner sheath.

In order that a detonating cord having a stainless steel outer sheath and an aluminium inner sheath is sufficiently flexible to be coiled inside a typical warhead the inner sheath preferably has an outside diameter of between 0.65 mm and 1.00 mm and the outer sheath preferably has an outside diameter of between 1.80 mm and 2.50 mm. It has been found that such a cord is capable of being coiled to a radius of 20 mm without kinking.

According to the invention in a second aspect there is provided a method of manufacturing a detonating cord according to the first aspect of the invention comprising the steps of:

(a) filling an inner sheath with high explosive, (b) drawing the inner sheath out so as to extend its length, reduce its diameter and compress the explosive contained therein, (c) placing the drawn down inner sheath into an outer sheath, and (d) drawing down the outer sheath over the inner sheath so as to simultaneously extend its length and reduce the diameter of the outer sheath to below 2.50 mm and until it grippingly engages the inner sheath, the outer sheath having a hoop strength which is higher than that of the inner sheath and which is sufficient to prevent plastic deformation of the outer sheath when the cord is detonated.

The method preferably involves increasing the density of the explosive by at least 50%.

BRIEF DESCRIPTION OF DRAWINGS

The invention will now be described by way of example with reference to FIGS. 1 to 4 which show.

DETAILED DESCRIPTION OF PREFERRED EMBODIMENTS

Figure 3:
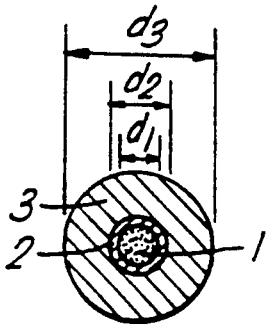
FIG. 3 A cross section of the detonating cord according to the invention.

The detonating cord shown in FIG. 3 comprises a compressed core 1 of the high explosive HNS, having diameter $d_1$ of 0.7 mm contained within an inner sheath 2 of 99.5% pure aluminium which has an outer diameter $d_2$ of 0.85 mm and a tensile strength of approximately 100 MPa. The inner sheath 2 is constrained within and grippingly engaged by an outer sheath 3 of stainless steel having an outer diameter $d_3$ of 2.0 mm and a strength of 500 MPa or more.

Figure 1:
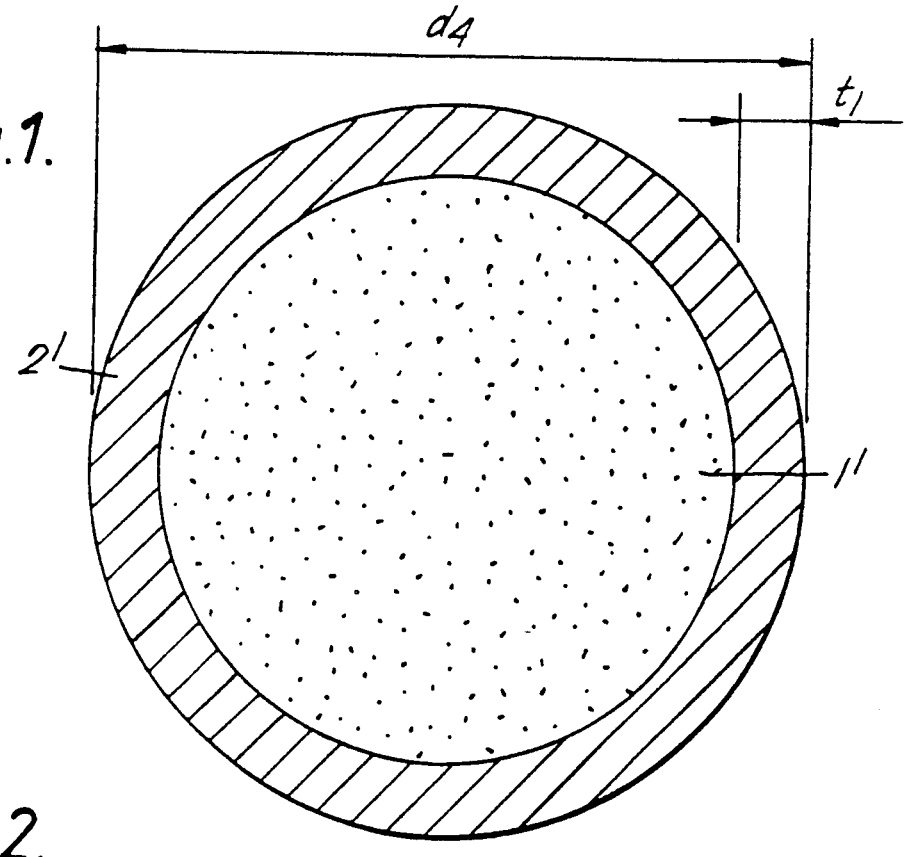
FIG. 1 A cross section of the inner sheath packed with explosive prior to drawing down.
Figure 2:
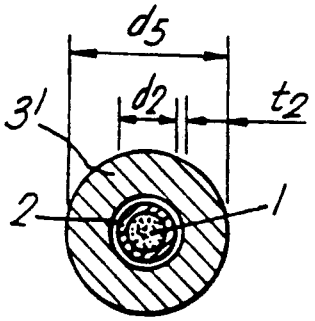
FIG. 2 A cross section of the drawn-down inner sheath positioned in the outer sheath ready for the drawing down of the outer sheath onto the inner sheath.

The method of manufacturing the detonating cord shown in FIG. 3 will now be described with additional reference to FIGS. 1 and 2.

An inner tube 2' of 99.5% pure aluminium having an outer diameter $d_4$ of 10 mm and a wall thickness $t_1$ of 1 mm is packed with recrystallised HNS explosive, at a packing density of 40 grams per meter of tube (0.8 g/cm$^3$), while the tube is vibrated.

The tube 2' is then drawn down with a conventional wire drawing machine in several steps until it has an outer diameter $d_2$ of 0.85 mm which results in the explosive core being compacted to a density of 1.4 g/cm$^3$. Successive draws are performed by drawing the tube back and forth through the machine. Aluminium having a purity of 99.5% has an appropriate ductility to ensure that sufficient but not excessive compaction of the explosive takes place as the tube is drawn down.

The resulting inner sheath 2, with its compressed core 1 is then slid into a stainless steel tube 3' having an outer diameter $d_5$ of 2.2 mm a wall thickness $t_2$ of 0.6 mm and an unworked tensile strength of 250 MPa. The stainless steel outer tube 3' is then drawn down (to form the outer sheath 3) until it just contacts the inner sheath 2 and is then further drawn down so that its outer diameter is reduced by a further 0.05 mm thus providing an interference fit between the sheaths. The final strength of the outer sheath is above 500 MPa and thus in the cords final state the hoop strength of the outer sheath is over 30 times the hoop strength of the inner sheath.

Figure 4:
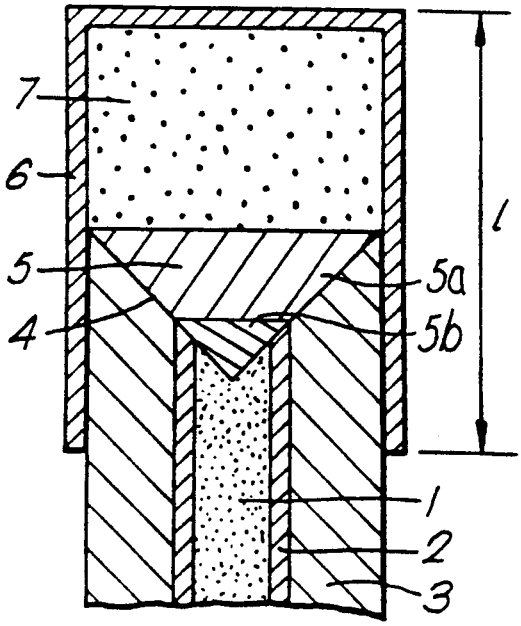
FIG. 4 A cross section of an end cap connected to a detonating cord according to the invention.

The detonation energy available from such a small cord is very low and for this reason a conical recess 4 is drilled in the end of the cord and packed with a cone of explosive 5 as shown in FIG. 4. The cone of explosive contains two layers of explosive, the layer **5*a* nearer to the cord's core being compressed to a lower extent than the layer 5*b* further from the core. This cone of explosive magnifies the detonation energy available to detonate an end cap. A typical end cap is shown in FIG. 4, and comprises an aluminium cap 6 filled with explosive 7. The cap 6 has an outside diameter of 2.3 mm and a length 1** of 6 mm.

Tests on detonating cord constructed as described above showed that its detonation velocity was insensitive to temperature variation. Over a temperature range of +60° C. to −60° C. the detonation velocity (average value 6289 m/s) of different samples of the cord varied by only 3.4%. At a constant temperature (20° C.) different samples of the cord also provided a low detonation velocity variation of ±0.4%. The outer diameter $d_3$ of the cord was the same both before and after detonation had taken place.

I claim:

1. Flexible detonating cord comprising:

an inner sheath having a hoop strength;

a core of radially compacted high explosive contained within said inner sheath; and an outer sheath having a hoop strength, wherein said outer sheath coaxially grippingly engages said inner sheath, the hoop strength of the outer sheath being greater than the hoop strength of the inner sheath, wherein the outer sheath has an outer diameter of less than 2.50 mm and said outer sheath hoop strength, said inner sheath hoop strength and said high explosive comprise a means for preventing plastic deformation of the outer sheath when the explosive is detonated.

2. Detonating cord as claimed in claim 1 wherein said inner sheath is comprised of a material more ductile than material comprising the outer sheath.

3. Detonating cord as claimed claim 1 wherein said explosive is compressed to a density of between 1.2 and 1.6 g/cm$^3$.

4. Detonating cord as claimed in claim 1 wherein the inner sheath comprises at least one of aluminium and silver.

5. Detonating cord as claimed in claim 1 wherein the hoop strength of the outer sheath is at least 15 times the hoop strength of the inner sheath.

6. Detonating cord as claimed in claim 1 wherein said outer sheath has an ultimate tensile strength above 500 MPa.

7. Detonating cord as claimed in claim 1 wherein the outer sheath comprises work hardened metallic material.

8. Detonating cord as claimed in claim 7 wherein the outer sheath comprises work hardened steel.

9. Detonating cord as claimed in claim 1 wherein the inner sheath has an outer diameter of between 0.65 mm and 1.00 mm.

10. Detonating cord as claimed in claim 1 wherein the outer sheath has an outer diameter of between 1.80 mm and 2.50 mm.

11. A method of manufacturing a detonating cord comprising the steps of:

(a) filling an inner sheath with high explosive, (b) drawing the inner sheath out so as to simultaneously extend its length, reduce its diameter and compress the explosive contained therein, (c) placing the drawn down inner sheath into an outer sheath, and (d) drawing down the outer sheath over the inner sheath so as to work harden the outer sheath and to simultaneously extend the outer sheath length and reduce the diameter of the outer sheath to below 2.50 mm and until it grippingly engages the inner sheath, the outer sheath having a hoop strength which is higher than that of the inner sheath and which is sufficient to prevent plastic deformation of the outer sheath when the cord is detonated.

12. A method as claimed in claim 11 wherein the inner sheath is drawn down in step (b) to a final outside diameter of between 0.65 mm and 1.0 mm.

13. A method as claimed in claim 11 wherein the outer sheath is drawn down in step (d) to a final outside diameter of between 1.80 mm and 2.50 mm.

14. A method as claimed in claim 11 wherein steps (b) and (d) together comprise the step of increasing the density of the explosive within the inner sheath to between 1.2 and 1.6 g/cm$^3$.

15. A method as claimed in claim 11 wherein steps (b) and (d) together comprises the step of increasing the density of the explosive by at least 50%.

16. A method as claimed in claim 11 wherein the inner sheath comprises one of silver and alumunium.

17. A method as claimed in claim 11 wherein there is a further step of word hardening the outer sheath.

18. A method as claimed in claim 17 wherein the outer sheath comprises steel.

19. A method as claimed in claim 17 step (d) includes the step of increasing the ultimate tensile strength of the outer sheath to above 500 MPa.

* * * * *